US012161173B2

(12) United States Patent
Zhang et al.

(10) Patent No.: US 12,161,173 B2
(45) Date of Patent: Dec. 10, 2024

(54) BREAST PUMP BRA

(71) Applicant: SHENZHEN ROOT INNOVATION TECHNOLOGY CO., LTD., Shenzhen (CN)

(72) Inventors: Chuyin Zhang, Shenzhen (CN); Lirong Liao, Shenzhen (CN)

(73) Assignee: Shenzhen Root Innovation Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/116,317

(22) Filed: Mar. 2, 2023

(65) Prior Publication Data

US 2023/0404177 A1 Dec. 21, 2023

(30) Foreign Application Priority Data

Jun. 15, 2022 (CN) ..... 202210670222.9

(51) Int. Cl.
*A41C 3/04* (2006.01)

(52) U.S. Cl.
CPC ..... *A41C 3/04* (2013.01)

(58) Field of Classification Search
CPC ..... A41C 3/04
USPC ..... 450/36
See application file for complete search history.

(56) References Cited

U.S. PATENT DOCUMENTS 3,532,096 A * 10/1970 Seidl ..... A61F 13/141 450/86
11,006,678 B1 * 5/2021 Ye ..... A41C 3/04
2008/0064299 A1 * 3/2008 La Fontaine ..... A41C 3/04 450/36
2011/0092134 A1 * 4/2011 Alva ..... A61M 1/062 450/39
2016/0015092 A1 * 1/2016 Abbaszadeh ..... A61M 1/067 450/36
2016/0021939 A1 * 1/2016 Taheri ..... A61M 1/062 450/36
2017/0280786 A1 * 10/2017 Abbaszadeh ..... A61M 1/062
2018/0000168 A1 * 1/2018 Alva ..... A41D 1/215
2018/0214066 A1 * 8/2018 Goodall ..... A61B 5/1077
2018/0296741 A1 * 10/2018 Hill ..... A61M 1/062
2020/0154792 A1 * 5/2020 Abbaszadeh ..... A61M 1/062
2020/0245922 A1 * 8/2020 Goodall ..... A61B 5/1073
2020/0297042 A1 * 9/2020 Carlino ..... A41D 1/215
2021/0345690 A1 * 11/2021 Stanton ..... A41C 3/04
2023/0320435 A1 * 10/2023 Carlino ..... A41C 3/08 450/36

* cited by examiner

*Primary Examiner* — Gloria M Hale
(74) *Attorney, Agent, or Firm* — Bayramoglu Law Offices LLC

(57) ABSTRACT

A breast pump bra cup is provided. An elastic compression area can form an elastic compression force almost perpendicular to a surface of a cup and pointing to the inside of the cup when the bra is worn. A length direction of a first opening is the same as that of a second blind opening. The first opening, the first blind opening and one end of the second blind opening in the length direction intersect and are in a connected state. One end of a first blind opening limit line is connected with an O1 end of the second blind opening, so that the first blind opening coincides with the second blind opening in a direction close to the O1 end and is in a connected state. The opening on the bra cup can be stuffed into a breast pump flange while the length is smaller.

20 Claims, 4 Drawing Sheets

BREAST PUMP BRA

CROSS REFERENCE TO THE RELATED APPLICATIONS

This application is based upon and claims priority to Chinese Patent Application No. 202210670222.9 filed on Jun. 15, 2022, the entire contents of which are incorporated herein by reference.

TECHNICAL FIELD

The present invention belongs to the technical field of bras, in particular to a breast pump bra.

BACKGROUND

With the quickening pace of life, it is a great challenge for modern women, especially professional women, to breast-feed their babies. In addition to breast feeding, breast pumps are generally used to store breast milk.

The use of the breast pump requires at least one hand to support the breast pump throughout the whole process, and it usually takes about 8 minutes for a single breast pumping session. In order to meet the needs of infants for breast milk, lactating women need to pump bread milk every 2-3 hours, and 8-12 times a day. Such high-frequency activities will not only lead to arm fatigue and even tenosynovitis of lactating women, but also delay the work of lactating women.

In order to free the hands of lactating women in breast pumping, people designed a breast pump bra matched with the use of breast pump, which is characterized in that the bra itself can fix the breast pump. However, the opening of the existing breast pump bra is simple, and generally adopts a zigzag opening design. On the one hand, in order to insert the breast pump flange from the opening, the length of the opening is generally designed to be equal to the diameter of the breast pump flange, so that the pressure of the whole bra on the flange is not large enough. With the increase of milk in the breast pump, the breast pump is easy to wobble or even slide out of the opening after gaining weight. On the other hand, in use of breast pumps, breasts are exposed too much, resulting in a failure to protect privacy of lactating women.

SUMMARY

To solve the above existing technical problem, the present invention provides a breast pump bra.

To achieve the above purpose, the technical solution adopted by the present invention is as follows:

a breast pump bra cup structure is provided, which includes:

a cup body having a first connecting part, a second connecting part and a third connecting part;

a flange connecting port with a surface inlet and an inner inlet, where the first connecting part is configured for connecting with a shoulder strap;

where the second connecting part is configured for connecting to a center front;

where the third connecting part is configured for connecting with a side wing;

where a first elastic compression area is disposed between the first connecting part and the second connecting part; and a second elastic compression area is disposed between the first connecting part and the third connecting part; and a third elastic compression area is disposed between the second connecting part and the third connecting part; and a connecting port area surrounded by the first elastic compression area, the second elastic compression area and the third elastic compression area is provided;

where the elastic compression area is capable of forming an elastic compression force almost perpendicular to a surface of the cup and pointing to inside of the cup when the bra is worn;

where the surface inlet has a first blind opening with a length of L1 and a first opening with a length of L2, and the inner inlet has a second blind opening with a length of L3; and a length direction a1 of the first blind opening is different from a length direction a2 of the first opening; and the length direction of the first opening is the same as that of the second blind opening, the first opening, the first blind opening and one end of the second blind opening in the length direction intersect and are in a connected state.

a first blind opening limit line is provided at a position almost parallel to the direction a1, and one end of a first blind opening limit line is connected with an O1 end of the second blind opening, so that the first blind opening coincides with the second blind opening in a direction close to the O1 end and is in a connected state;

where the O1 end is an end of the second blind opening away from the first opening.

Preferably, a flange diameter L0 of the breast pump and L1, L2 and L3 satisfy following relational expressions:

$$L1+L0 \geq L2; \text{ and}$$

$$L2+L3 \geq L0.$$

Preferably, the breast pump bra structure includes:

a cutting piece A12;

the cutting piece A12 having the first elastic compression area connecting the first connecting part and the second connecting part; and the second elastic compression area connecting the first connecting part and the third connecting part, where the first elastic compression area and the second elastic compression area form a V-shaped structure; and the first connecting part is a connecting area with a V-shaped structure.

Preferably, the breast pump bra structure includes:

a cutting piece A3 capable of covering a notch area of the V-shaped structure of the cup, where the cutting piece A3 has a first overlapping area with the first elastic compression area of the cutting piece A12, and the cutting piece A3 has a second overlapping area with the second elastic compression area of the cutting piece A12; and the cutting piece A3 and the cutting piece A12 are connected in the second compression area to form the first blind opening limit line.

Preferably, a first elastic strip is disposed in the first blind opening limit line, where the first elastic strip is configured for improving a stretching ability of the first blind opening limit line.

Preferably, the cutting piece A3 and the cutting piece A12 are provided with a connecting line M1 in the first overlapping area so that the cutting piece A3 is connected with the cutting piece A12 to form a third elastic compression area.

Preferably, the cutting piece A3 is disposed in the second overlapping area in an inner cup direction of the cutting piece A12; and the cutting piece A3 is disposed in the first overlapping area in an outer cup direction of the cutting piece A12.

Preferably, the cutting piece A3 is triangular.

Preferably, the breast pump bra structure includes:

a cutting piece A1 and a cutting piece A2;

the cutting piece A1 having the first elastic compression area connecting the first connecting part and the second connecting part;

the cutting piece A2 having the second elastic compression area connecting the first connecting part and the third connecting part, where the first elastic compression area and the second elastic compression area form a V-shaped structure; and the first connecting part is a connecting area with a V-shaped structure.

Preferably, the bra body is provided with two inner cups;

where the inner cups are made using the breast pump bra cup structure as described above.

Preferably, the breast pump bra structure includes:

a shoulder strap;

the shoulder strap including a quilted front strap and a back strap;

where the quilted front strap is connected with a first connecting part through a nursing snap hook; and where the back strap is connected with a back wing of the bra body through a shoulder strap buckle.

Preferably, the quilted front strap includes two pieces of cloth and a cotton core, where the cotton core is located between the two pieces of cloth; and edges of the two pieces of cloth are connected.

Preferably, the bra body includes two outer cups, where the two outer cups are disposed at front chest parts of the bra body corresponding to positions of the two inner cups.

Preferably, the breast pump bra structure includes:

a nursing ring;

where the nursing ring is connected with an upper side of the front chest part of the bra body.

Preferably, a lower part of a bottom wing of the bra body is rib stitch, where the rib stitch is configured for improving an elasticity of an under bust of the breast pump bra in wearing.

Preferably, a joint of a lower part and an upper part of the bottom wing of the bra body is provided with a second elastic strip, where the second elastic strip is configured for covering seams of the cutting pieces in the two inner cups.

The beneficial effect of the present invention is reflected in the fact that a breast pump bra is provided so that the opening on the bra cup can be stuffed into a breast pump flange while the length is smaller, the opening has less impact on the compression force of the entire bra cup making the compression force enough to stop the breast pump flange that is full of milk from wobbling and sliding out of the opening, and the opening is covered to protect the privacy of breastfeeding women, and the design of outer cup is more convenient so that women do not need to change their underwear when using the breast pump and do not need to change their underwear after use.

DETAILED DESCRIPTION OF THE EMBODIMENTS

Figure 1:
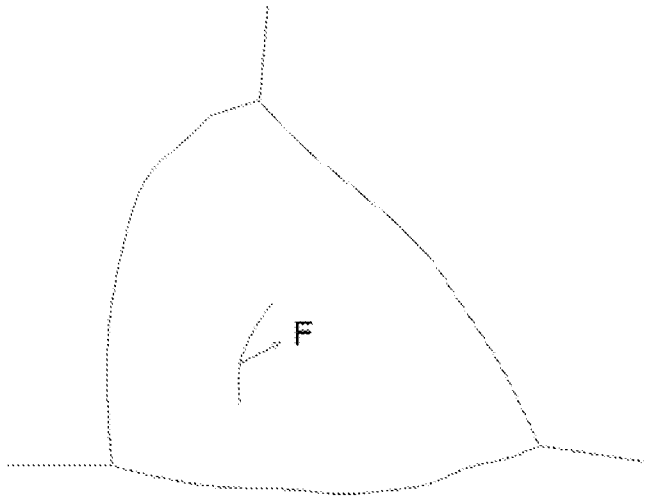
FIG. 1 is a schematic diagram of a common breast cup of an embodiment of the present invention.
Figure 2:
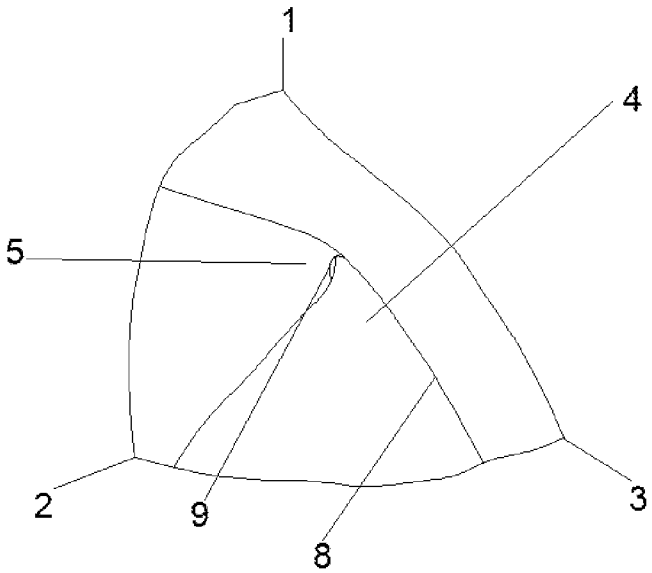
FIG. 2 is a structural schematic diagram of a surface inlet of an embodiment of the present invention.
Figure 3:
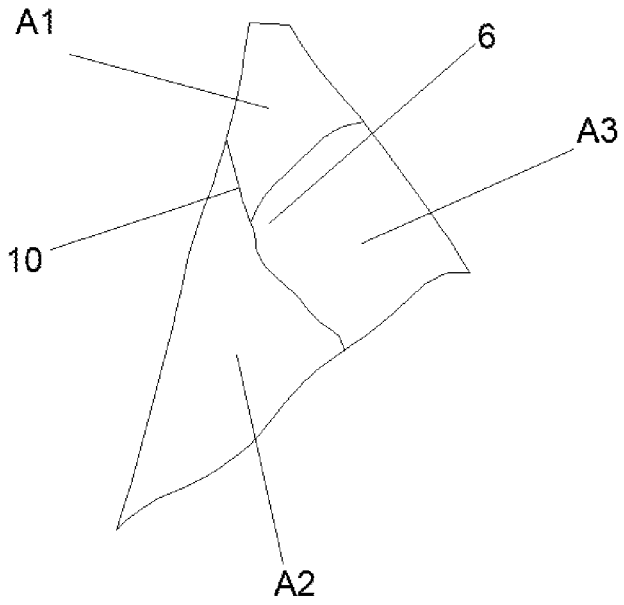
FIG. 3 is a structural schematic diagram of an inner inlet of an embodiment of the present invention.
Figure 4:
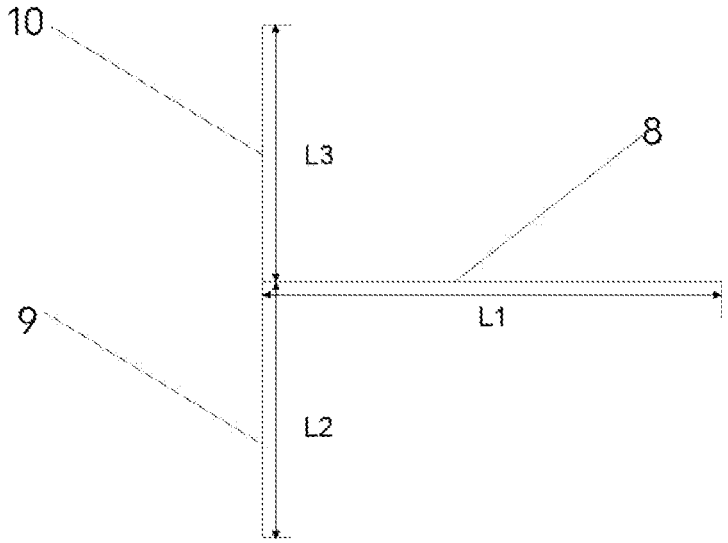
FIG. 4 is a schematic diagram of relationship among a first blind opening, a second blind opening and a first opening of an embodiment of the present invention.
Figure 5:
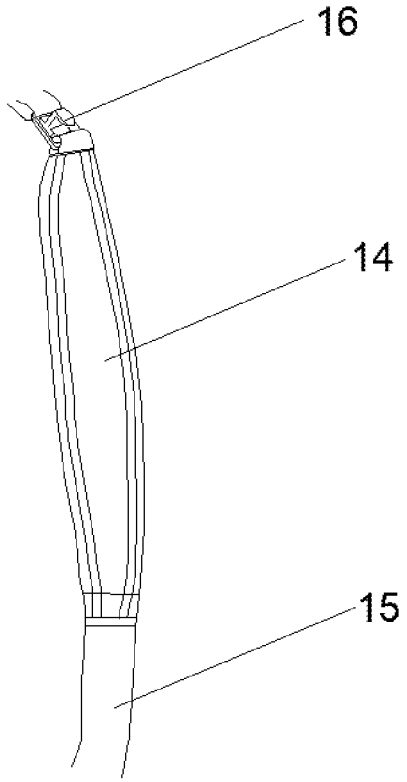
FIG. 5 is a structural schematic diagram of a shoulder strap of the embodiment of the present invention.
Figure 6:
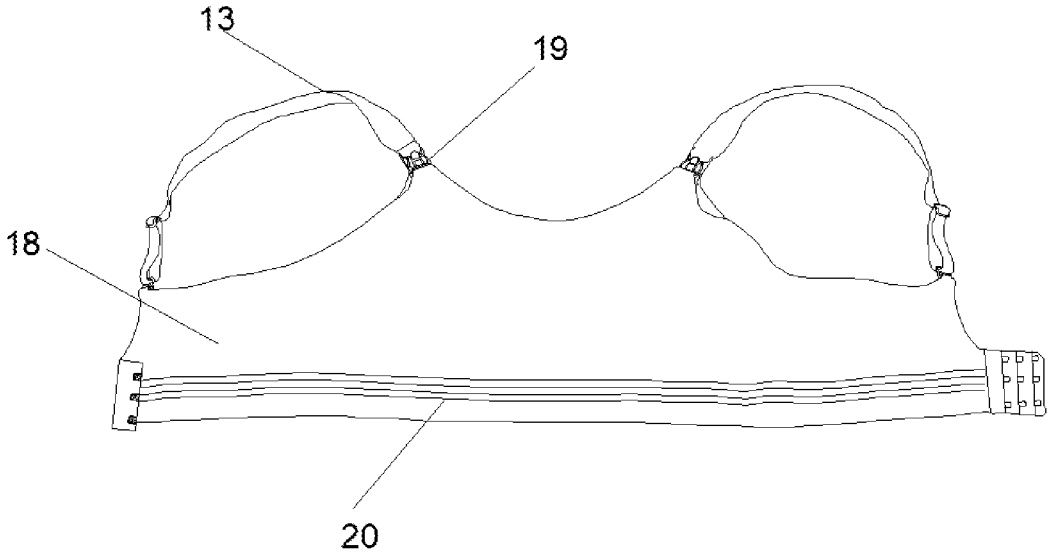
FIG. 6 is a structural schematic diagram of a front chest part of an embodiment of the present invention.
Figure 7:
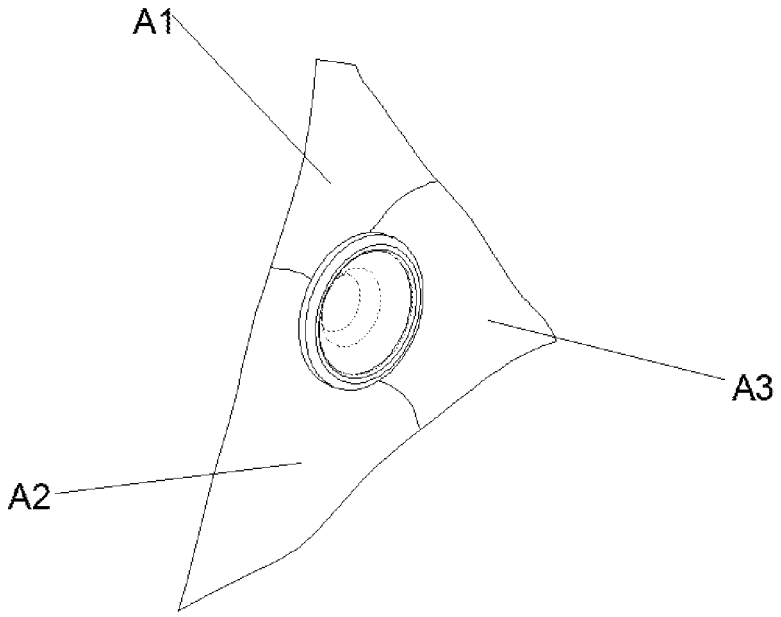
FIG. 7 is a schematic diagram of a flange assembly of an embodiment of the present invention.
Figure 8:
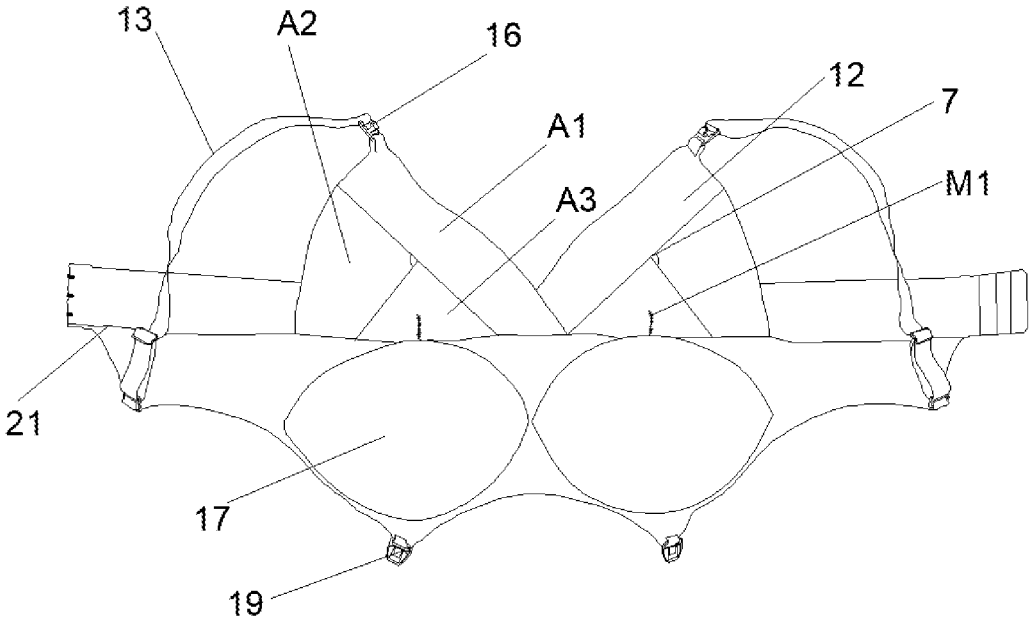
FIG. 8 is a structural schematic diagram of a bra of an embodiment of the present invention.

A clear and complete description of the technical solution in the embodiments of the present invention will be made below in conjunction with the accompany drawings in the embodiments of the present invention. Obviously, the described embodiments are only part of the embodiments of the present invention, but not all of them. Based on the embodiments of the present invention, all other embodiments obtained by those ordinarily skilled in the art without exerting creative effort fall within the scope of protection of the present invention.

Please refer to FIGS. 1-8, specific embodiments of the present invention are provided as follows:

Embodiment 1

A breast pump bra cup structure which includes:

a cup body 4 having a first connecting part 1, a second connecting part 2 and a third connecting part 3;

a flange connecting port 7 with a surface inlet 5 and an inner inlet 6, where the first connecting part 1 is configured for connecting with a shoulder strap 13;

where the second connecting part 2 is configured for connecting to a center front;

where the third connecting part 3 is configured for connecting with a side wing;

where a first elastic compression area is disposed between the first connecting part 1 and the second connecting part 2; and a second elastic compression area is disposed between the first connecting part 1 and the third connecting part 3; and a third elastic compression area is disposed between the second connecting part 2 and the third connecting part 3; and a connecting port area surrounded by the first elastic compression area, the second elastic compression area and the third elastic compression area is provided;

where the elastic compression area is capable of forming an elastic compression force almost perpendicular to a surface of the cup and pointing to inside of the cup when the bra is worn;

where the surface inlet 5 has a first blind opening 8 with a length of L1 and a first opening 9 with a length of L2, and the inner inlet 6 has a second blind opening 10 with a length of L3; and a length direction a1 of the first blind opening 8 is different from a length direction a2 of the first opening 9; and the length direction of the first opening 9 is the same as that of the second blind opening 10, the first opening 9, a first blind opening 8 and one end of the second blind opening 10 in the length direction intersect and are in a connected state.

a first blind opening limit line 11 is provided at a position almost parallel to the direction a1, and one end of a first blind opening limit line 11 is connected with an O1 end of the second blind opening 10, so that the first blind opening 8 coincides with the second blind opening 10 in a direction close to the O1 end and is in a connected state;

where the O1 end is an end of the second blind opening 10 away from the first opening 9.

Refer to FIG. 1, ordinary bra cups will be subjected to forces from shoulder straps, center front and side wings. These forces will be transmitted to the whole cup, and since the bra cups are in three-dimensional fashion after being worn, these forces will decompose into a compression force F perpendicular to a surface of the cup and pointing to the inside of the cup so that the cup can cover the breast, but if an opening is made on the surface of the cup to make the flange pass through, and the diameter of the flange is similar to the size of the cup, it will have a great influence on the force transmission, so that there is no compression force at the opening and the compression force near the opening is small. Therefore, the opening should not be too large, and it is necessary to ensure that the opening can allow the flange to pass through while the compression force on the cup is enough to compress the flange so that the breast pump filled with milk will not fall out.

In this embodiment, the present invention provides a breast pump bra cup structure. The cup has a flange connection port with a surface inlet and an inner inlet, the surface inlet is provided with a first blind opening and a first opening, the inner layer inlet has a second blind opening. A length direction a1 of the first blind opening is different from a length direction a2 of the first opening. The length direction of the first opening is the same as a length direction of the second blind opening. The first opening, the first blind opening and one end of the second blind opening in the length direction intersect and are in a connected state. One end of a first blind opening limit line is connected with an O1 end of the second blind opening, so that the first blind opening coincides with the second blind opening in a direction close to the O1 end and is in a connected state. It appears that only the first opening is open, but in fact, the first opening, the first blind opening and one end of the second blind opening in the length direction intersect and are communicated. The first opening is connected with the second blind opening, therefore, the flange first enters the first blind opening, and then enters the bra through the connected first opening and the second blind opening, so the length L2 of the first opening does not need to be greater than or equal to the flange diameter. When the bra is put on, the first elastic compression area, the second elastic compression area, and the third elastic compression area may form a compression force that is nearly perpendicular to the surface of the cup and pointing to the inside of the cup. However, this compression force does not exist only at the first opening, the first opening is not large, so the compression force of the whole cup is enough to compress the flange to prevent the breast pump filled with milk from falling out. At the same time, because the length of the first opening is less than the diameter of the flange, the first opening will also become a lock to limit the flange of the breast pump from falling out.

Preferably, a flange diameter L0 of the breast pump and L1, L2 and L3 satisfy following relational expressions:

$$L1+L0 \geq L2; \text{ and}$$

$$L2+L3 \geq L0.$$

In the preferred solution of this embodiment, the flange diameter L0 of the breast pump is greater than or equal to the length L2 of the first opening and less than or equal to the length L1 of the second blind opening, L2+L3≥L0, and the ranges of L1, L2 and L3 are given according to the flange diameter.

Embodiment 2

The breast pump bra cup structure includes a cutting piece A12;

the cutting piece A12 having the first elastic compression area connecting the first connecting part 1 and the second connecting part 2; and the second elastic compression area connecting the first connecting part 1 and the third connecting part 3, where the first elastic compression area and the second elastic compression area form a V-shaped structure; and the first connecting part 1 is a connecting area with a V-shaped structure.

The breast pump bra cup structure includes a cutting piece A3 capable of covering a notch area of the V-shaped structure of the cup;

where the cutting piece A3 has a first overlapping area with the first elastic compression area of the cutting piece A12, and the cutting piece A3 has a second overlapping area with the second elastic compression area of the cutting piece A12; and the cutting piece A3 and the cutting piece A12 are connected in the second compression area to form the first blind opening limit line 11.

In this embodiment, the present invention provides cutting piece shapes and cutting piece connection modes. The cutting piece A12 has a V-shaped structure, the cutting piece A3 can cover the notch area of the V-shaped structure of the cup, the cutting piece A3 and the first elastic compression area of the cutting piece A12 have a first overlapping area, the cutting piece A3 and the second elastic compression area of the cutting piece A12 have a second overlapping area, and the cutting piece A3 and the cutting piece A12 are connected in the second overlapping area to form the first blind opening limit line. The cutting pieces A3 and A12 have two overlapping areas, i.e., areas where two V-shaped legs of the cutting piece A3 and the cutting piece A12 are overlapped, and the cutting piece A3 and the cutting piece A12 are connected in the second overlapping area to form the first blind opening limit line, the overlapping and connecting of the cutting pieces makes a first opening, a first blind opening and a second blind opening form between the cutting pieces while the first opening is covered by the cutting piece A3 so that less area of the bra is exposed and the privacy can be protected.

Preferably, a first elastic strip is disposed in the first blind opening limit line 11, where the first elastic strip is configured for improving a stretching ability of the first blind opening limit line.

In this embodiment, the first elastic strip is arranged in the first blind opening limit line, and the first elastic strip is used for improving the stretching ability of the first blind opening limit line. After the supported object is installed, due to the thickness of the flange plate, the cutting piece will bulge outward and be in a stretched state after the flange is put in. The elastic strip has good elasticity, which can provide an inward pressure so that the flange clings to the breast and is not easy to wobble.

Embodiment 3

The cutting piece A3 and the cutting piece A12 are provided with a connecting line M1 in the first overlapping area so that the cutting piece A3 is connected with the cutting piece A12 to form a third elastic compression area.

In this embodiment, the cutting piece A3 and the cutting piece A12 are provided with the connecting line M1 in the first overlapping area so that the cutting piece A3 and the cutting piece A12 are connected to form a third elastic compression area, and the force given by the center front, shoulder straps and side wings can be transmitted between the cutting piece A3 and the cutting piece A12, the force of the whole cup can be transmitted except the opening, and the compression effect is better. Compared with the cloth, the connecting line M1 is stiffer, which can increase the supporting force for the breast pump.

Preferably, the cutting piece A3 is disposed in the second overlapping area in an inner cup direction of the cutting piece A12; and the cutting piece A3 is disposed in the first overlapping area in an outer cup direction of the cutting piece A12.

In the preferred solution of this embodiment, the cutting piece A3 is disposed in the second overlapping area in an inner cup direction of the cutting piece A12, and the cutting piece A3 is disposed in the first overlapping area in an outer cup direction of the cutting piece A12. This overlapping allows the first opening to be covered by the cutting piece A3 so that less area of the bra is exposed and the privacy can be protected.

Embodiment 4 the cutting piece A3 is triangular.

In the preferred solution of this embodiment, the cutting piece A3 is triangular, because the notch area of the V-shaped structure of the cup is triangular, the triangular design can save cloth while covering the notch area of the V-shaped structure of the cup.

Embodiment 5

The breast pump bra cup structure includes a cutting piece A1 and a cutting piece A2;

the cutting piece A1 having the first elastic compression area connecting the first connecting part and the second connecting part;

the cutting piece A2 having the second elastic compression area connecting the first connecting part and the third connecting part, where the first elastic compression area and the second elastic compression area form a V-shaped structure; and the first connecting part is a connecting area with a V-shaped structure.

In this embodiment, the breast pump bra cup structure includes the cutting piece A1 and the cutting piece A2, the cutting piece A1 has a first elastic compression area, the cutting piece A2 has a second elastic compression area, and the first elastic compression area and the second elastic compression area form a V-shaped structure. Cutting the cutting piece directly into a V-shaped structure is cost. In the embodiment, the V-shaped structure is formed by splicing two cutting pieces, and the cutting does not require the shape of the two cutting pieces separately, as long as they are connected in a V-shape to improve working efficiency.

Embodiment 5

A breast pump bra including a bra body is provided.

The bra body is provided with two inner cups 12;

where the inner cups 12 are made using the breast pump bra cup structure as described above.

In this embodiment, the two inner cups of the breast pump bra are made of the breast pump bra cup structure as described above, and the breast pump bra made in this way can achieve that the compression force of the whole cup is sufficient to compress the flange so that the breast pump with milk does not fall out and the flange of the breast pump cannot fallout from the first opening.

Embodiment 6

The breast pump bra includes a shoulder strap 13.

The shoulder strap 13 includes a quilted front strap 14 and a back strap 15;

where the quilted front strap 14 is connected with a first connecting part 1 through a nursing snap hook 16; and where the back strap 15 is connected with a back wing of the bra body through a shoulder strap buckle 13.

Since the breast weight of lactating women increases due to milk secretion, the use of common shoulder straps may cause the breast weight to exert greater pressure on the shoulders, which can produce strangulation marks and even cause shoulder pain when the bra was worn for a long time.

In this embodiment, the shoulder strap includes a quilted front strap and a back strap, and the quilted front strap is adopted at a part directly in contact with the shoulders, and a width of the quilted front strap is slightly wider than that of the common shoulder strap, so as to reduce the pressure on the shoulders.

Preferably, the quilted front strap 14 includes two pieces of cloth and a cotton core, where the cotton core is located between the two pieces of cloth; and edges of the two pieces of cloth are connected.

In the preferred solution of the embodiment, the quilted front strap is made by placing a cotton core between two pieces of cloth. The cotton core is a sponge. The cotton core is placed between the two pieces of cloth, and then binding process is performed on edges of the cloth, so as to wrap the cotton core and reduce the friction of the shoulder straps on the shoulder skin. Also, the cotton core has a good sweat absorption effect, which keeps the shoulder skin dry.

Embodiment 7

The bra body includes two outer cups 17;

where the two outer cups 17 are disposed at front chest parts 18 of the bra body corresponding to positions of the two inner cups 12.

In the embodiment, the two outer cups are arranged on the front chest parts of the bra body corresponding to the two inner cups, which can not only cover the inner cups when the breast pump is not used, so that the appearance of the breast pump bra is simple and beautiful, but also reduce the external collision impact on the breasts of lactating women and prevent embarrassment of bumps.

Embodiment 8

The breast pump bra includes a nursing ring 19;

where the nursing ring 19 is connected with an upper side of each of the front chest parts of the bra body.

In this embodiment, the breast pump bra includes a nursing ring, which is connected with the upper side of the front chest part of the bra body, and is used together with the nursing hook to play the role of detachable connection of the front chest part. When the breast pump is in use, the nursing ring is removed from the nursing hook, and then the inner cup is exposed for use with the breast pump. After the breast pumping is completed, the nursing ring is hung into the nursing hook, so that the front chest part completely covers the inner cup, and the whole process can be operated with one hand, which is more convenient.

Embodiment 9

A lower part of a bottom wing of the bra body is rib stitch 20;

where the rib stitch 20 is configured for improving an elasticity of an under bust of the breast pump bra when in wearing.

In this embodiment, a lower part of a bottom wing of the bra body is rib stitch 20, to be used to improve an elasticity of an under bust of the breast pump bra in wearing. Since the rib stitch has good elasticity, when wearing breast pump bra, it can adapt to different under busts of women with the same bust circumference. At the same time, rib tissue has good sweat absorption, which can also keep the skin of the wearer's lower bust dry, avoid sultry and humid, and prevent breast infection and inflammation caused by bacteria breeding.

Embodiment 10

A joint of a lower part and an upper part of the bottom wing of the bra body is provided with a second elastic strip 21;

where the second elastic strip 21 is configured for covering seams of the cutting pieces in the two inner cups.

In this embodiment, a joint of a lower part and an upper part of the bottom wing of the bra body is provided with a second elastic strip, which is used to cover seams of the cutting pieces in the two inner cups, so that the appearance is smooth and the comfort is increased due to the elasticity of the second elastic strip.

In the description of embodiments of the present invention, it is to be understood that the terms "up", "down", "front", "back", "left", "right", "vertical", "horizontal", "center", "tip", "base", "top", "bottom", "in", "out", "inside", "outside", etc. indicate the orientation or positional relationship.

In the description of embodiments of the present invention, it should be noted that the terms "install", "connect", "couple", "assemble" and the like are to be understood in a broad sense, unless otherwise expressly specified and limited, for example, it can be a fixed connection, may also be a detachable connection, or be an integral connection; it can be directly connected, or indirectly connected through an intermediate medium, or it can be an internal connection of two elements. For those ordinarily skilled in the art, the specific meanings of the above terms in the present invention will be understood according to the specific circumstances.

In the description of embodiments of the present invention, the specific features, structures, materials or characteristics described may be combined in a suitable manner in any one or more embodiments or examples.

In the description of embodiments of the present invention, it is to be understood that "-" and "~" denote a range between two values and that the range includes endpoints. For example, "A-B" means a range greater than or equal to A and less than or equal to B. "A~B" denotes a range greater than or equal to A and less than or equal to B.

In the description of embodiments of the present invention, the term "and/or" herein is simply a description of the association relationship of the associated objects, indicating that three relationships can exist, for example, A and/or B may indicate that A exists alone, A and B exist at the same time, and B exists alone. In addition, the character "/" herein generally means that the associated objects are in an "or" relationship.

Although the embodiments of the present invention have been shown and described, it will be understood to those of ordinary skill in the art that various changes, modifications, substitutions and variations may be made to these embodiments without departing from the principle and spirit of the present invention, the scope of present invention is defined by the appended claims and their equivalents.

What is claimed is:

1. A breast pump bra cup structure, comprising:

a cup body, wherein the cup body has a first connecting part, a second connecting part and a third connecting part; and a flange connecting port, wherein the flange connecting port is configured with a surface inlet and an inner inlet;

wherein the first connecting part is configured for connecting with a shoulder strap; the second connecting part is configured for connecting to a center front; the third connecting part is configured for connecting with a side wing;

wherein a first elastic compression area is disposed between the first connecting part and the second connecting part; a second elastic compression area is disposed between the first connecting part and the third connecting part; and a third elastic compression area is disposed between the second connecting part and the third connecting part;

a connecting port area is surrounded by the first elastic compression area, the second elastic compression area and the third elastic compression area;

wherein when a bra is worn, the first elastic compression area, the second elastic compression area, and the third elastic compression area are configured for forming an elastic compression force, wherein the elastic compression force is perpendicular to a surface of a cup and the elastic compression force points to an inside of the cup;

wherein the surface inlet has a first blind opening with a length of L1 and a first opening with a length of L2, and the inner inlet has a second blind opening with a length of L3; wherein a length direction of the first blind opening is different from a length direction of the first opening; and the length direction of the first opening is the same as a length direction of the second blind opening;

the first opening, the first blind opening and one end of the second blind opening in the length direction intersect and are in a first connected state;

a first blind opening limit line is provided at a position, wherein the position is parallel to the length direction of the first blind opening, and one end of the first blind opening limit line is connected with an O1 end of the second blind opening, wherein the first blind opening coincides with the second blind opening in a direction adjacent to the O1 end, and the first blind opening and the second blind opening are in a second connected state; and wherein the O1 end is an end of the second blind opening away from the first opening.

2. The breast pump bra cup structure according to claim 1, wherein a flange diameter L0 of a breast pump and L1, L2 and L3 satisfy following relational expressions:

$$L1+L0 \geq L2; \text{ and}$$

$$L2+L3 \geq L0.$$

3. The breast pump bra cup structure according to claim 1, comprising a first cutting piece, wherein the first cutting piece has the first elastic compression area and the second elastic compression area;

wherein the first elastic compression area connects the first connecting part and the second connecting part; and the second elastic compression area connects the first connecting part and the third connecting part; and wherein the first elastic compression area and the second elastic compression area form a V-shaped structure; and the first connecting part is a connecting area with the V-shaped structure.

4. The breast pump bra cup structure according to claim 3, comprising a second cutting piece, wherein the second cutting piece is configured for covering a notch area of the V-shaped structure of the cup;

wherein the second cutting piece has a first overlapping area with the first elastic compression area of the first cutting piece, and the second cutting piece has a second overlapping area with the second elastic compression area of the first cutting piece; and the second cutting piece and the first cutting piece are connected in the second overlapping area to form the first blind opening limit line.

5. The breast pump bra cup structure according to claim 4, wherein a first elastic strip is disposed in the first blind opening limit line, and wherein the first elastic strip is configured for improving a stretching ability of the first blind opening limit line.

6. The breast pump bra cup structure according to claim 5, wherein the second cutting piece and the first cutting piece are provided with a connecting line in the first overlapping area; and wherein the second cutting piece is connected with the first cutting piece to form the third elastic compression area.

7. The breast pump bra cup structure according to claim 3, wherein a second cutting piece is disposed in a second overlapping area in an inner cup direction of the first cutting piece; and the second cutting piece is disposed in a first overlapping area in an outer cup direction of the first cutting piece.

8. The breast pump bra cup structure according to claim 4, wherein the second cutting piece is triangular.

9. The breast pump bra cup structure according to claim 1, comprising a first cutting piece and a second cutting piece;

wherein the first cutting piece has the first elastic compression area, and the first elastic compression area connects the first connecting part and the second connecting part; the second cutting piece has the second elastic compression area, and the second elastic compression area connects the first connecting part and the third connecting part; and wherein the first elastic compression area and the second elastic compression area form a V-shaped structure; and the first connecting part is a connecting area with the V-shaped structure.

10. A breast pump bra, comprising a bra body, wherein the bra body is provided with two inner cups; and wherein each of the two inner cups is made by the breast pump bra cup structure according to claim 1.

11. The breast pump bra according to claim 10, comprising a shoulder strap, wherein the shoulder strap comprises a quilted front strap and a back strap; and wherein the quilted front strap is connected with the first connecting part through a nursing snap hook; and the back strap is connected with a back wing of the bra body through a shoulder strap buckle.

12. The breast pump bra according to claim 11, wherein the quilted front strap comprises two pieces of cloth and a cotton core; and wherein the cotton core is located between the two pieces of cloth; and edges of the two pieces of cloth are connected.

13. The breast pump bra according to claim 12, wherein the bra body comprises two outer cups; and wherein each of the two outer cups is disposed at each of front chest parts of the bra body corresponding to a position of each of the two inner cups.

14. The breast pump bra according to claim 13, comprising a nursing ring; and wherein the nursing ring is connected with an upper side of each of the front chest parts of the bra body.

15. The breast pump bra according to claim 14, wherein a lower part of a bottom wing of the bra body is rib stitch; and wherein the rib stitch is configured for improving an elasticity of an under bust of the breast pump bra in wearing.

16. The breast pump bra according to claim 15, wherein a joint of a lower part and an upper part of the bottom wing of the bra body is provided with a second elastic strip; and wherein the second elastic strip is configured for covering a seam of each of cutting pieces in each of the two inner cups.

17. The breast pump bra cup structure according to claim 2, comprising a first cutting piece, wherein the first cutting piece has the first elastic compression area and the second elastic compression area;

wherein the first elastic compression area connects the first connecting part and the second connecting part; and the second elastic compression area connects the first connecting part and the third connecting part; and wherein the first elastic compression area and the second elastic compression area form a V-shaped structure; and the first connecting part is a connecting area with the V-shaped structure.

18. The breast pump bra cup structure according to claim 4, wherein the second cutting piece is disposed in the second overlapping area in an inner cup direction of the first cutting piece; and the second cutting piece is disposed in the first overlapping area in an outer cup direction of the first cutting piece.

19. The breast pump bra cup structure according to claim 6, wherein the second cutting piece is triangular.

20. The breast pump bra cup structure according to claim 2, comprising a first cutting piece and a second cutting piece;

wherein the first cutting piece has the first elastic compression area, and the first elastic compression area connects the first connecting part and the second connecting part; the second cutting piece has the second elastic compression area, and the second elastic compression area connects the first connecting part and the third connecting part; and wherein the first elastic compression area and the second elastic compression area form a V-shaped structure; and the first connecting part is a connecting area with the V-shaped structure.

* * * * *